US007659805B2

(12) United States Patent
Takeda

(10) Patent No.: US 7,659,805 B2
(45) Date of Patent: Feb. 9, 2010

(54) THERMOSTAT

(75) Inventor: Hideaki Takeda, Misato (JP)

(73) Assignee: Uchiya Thermostat Co., Ltd. (JP)

( * ) Notice: Subject to any disclaimer, the term of this patent is extended or adjusted under 35 U.S.C. 154(b) by 244 days.

(21) Appl. No.: 11/667,102

(22) PCT Filed: Jan. 26, 2006

(86) PCT No.: PCT/JP2006/301252

§ 371 (c)(1),
(2), (4) Date: May 4, 2007

(87) PCT Pub. No.: WO2006/082749

PCT Pub. Date: Aug. 10, 2006

(65) Prior Publication Data

US 2007/0296540 A1 Dec. 27, 2007

(30) Foreign Application Priority Data

Feb. 2, 2005 (JP) ..... 2005-027101

(51) Int. Cl.
*H01H 37/12* (2006.01)
*H01H 37/54* (2006.01)
*H01H 37/52* (2006.01)
*H01H 37/00* (2006.01)

(52) U.S. Cl. ..... 337/365; 337/362; 337/380; 337/340; 337/391; 337/377

(58) Field of Classification Search ..... 337/365, 337/362, 380, 340, 391, 377
See application file for complete search history.

(56) References Cited

U.S. PATENT DOCUMENTS 2,533,671 A * 12/1950 Jacobs, Jr. ..... 200/407

(Continued)

FOREIGN PATENT DOCUMENTS

JP 5711439 1/1982

(Continued)

OTHER PUBLICATIONS

"International Search Report—Application No. PCT/JP2006/301252", (Apr. 2006),2 pgs.

(Continued)

*Primary Examiner*—Jayprakash N Gandhi
*Assistant Examiner*—Bradley H Thomas
(74) *Attorney, Agent, or Firm*—Schwegman, Lundberg & Woessner, P.A.

(57) ABSTRACT

A thermostat has a movable place where a spring point and a securing plate portion are integrally formed. The spring point is provided with a movable contact at a position that faces a fixed contact, a protrusion with which a bimetal that counter turns comes into contact, a hole for inserting the head of a bimetal holding point, and a protrusion for holding the bimetal, and the spring point is valley-folded at a folding point so as to face the securing plate portion. The securing plate portion is integrally constituted of a terminal point connected to one external terminal, a fixation point for securing an insulating plate, which has the fixed contact in a manner to hold the plate from both sides, and a holding point folded and set up, penetrating a central hole of the bimetal to hold the bimetal.

5 Claims, 9 Drawing Sheets

U.S. PATENT DOCUMENTS

| | | | | | |
|---|---|---|---|---|---|
| 2,584,460 | A | * | 2/1952 | Jacobs, Jr. | 200/407 |
| 3,146,378 | A | * | 8/1964 | Grenier | 361/32 |
| 3,196,233 | A | * | 7/1965 | Parkhurst et al. | 337/94 |
| 3,431,527 | A | * | 3/1969 | Epstein | 337/347 |
| 3,872,417 | A | * | 3/1975 | Hufschmid | 337/365 |
| 4,278,960 | A | * | 7/1981 | Muller et al. | 337/365 |
| 4,306,211 | A | * | 12/1981 | Hofsass | 337/89 |
| 4,316,168 | A | * | 2/1982 | Nakaho et al. | 337/359 |
| 4,317,097 | A | * | 2/1982 | Hofsass | 337/89 |
| 4,507,642 | A | * | 3/1985 | Blackburn | 337/89 |
| 4,755,787 | A | * | 7/1988 | Wehl | 337/372 |
| 4,847,587 | A | * | 7/1989 | Muller | 338/215 |
| 5,014,035 | A | * | 5/1991 | Hamada et al. | 337/372 |
| 5,182,538 | A | * | 1/1993 | Muller | 337/102 |
| 5,268,664 | A | * | 12/1993 | Givler | 337/380 |
| 5,309,131 | A | * | 5/1994 | Hofsass et al. | 337/102 |
| 5,337,036 | A | * | 8/1994 | Kuczynski | 337/343 |
| 5,367,279 | A | * | 11/1994 | Sakai | 337/104 |
| 5,585,774 | A | * | 12/1996 | Bennett | 337/365 |
| 5,847,637 | A | * | 12/1998 | Takeda et al. | 337/344 |
| 5,870,014 | A | * | 2/1999 | Nield et al. | 337/362 |
| 5,939,970 | A | * | 8/1999 | Tsuji et al. | 337/343 |
| 6,300,860 | B1 | * | 10/2001 | Hofsass | 337/377 |
| 6,538,553 | B2 | * | 3/2003 | Yu | 337/365 |
| 7,026,907 | B2 | * | 4/2006 | Takeda | 337/85 |

FOREIGN PATENT DOCUMENTS

| | | | |
|---|---|---|---|
| JP | 62222529 | A | 9/1987 |
| JP | 63501833 | A | 7/1988 |
| JP | 200138873 | | 11/1989 |
| JP | 5232936 | | 9/1993 |
| JP | 200606084440 | | 3/1994 |
| JP | 01166943 | U | 6/2001 |
| JP | 2003229041 | | 8/2003 |
| JP | 200526044 | A | 1/2005 |
| WO | WO-8703137 | | 5/1987 |

OTHER PUBLICATIONS

"Chinese Application Serial No. 200680001311.3, First Notification of Office Action mailed Apr. 3, 2009", (w/ English Translation), 12 pgs.

"Japanese Patent Application Serial No. 2007-501543, Notice of Rejection mailed Feb. 20, 2009", (w/ English Translation), 6 pgs.

* cited by examiner

PRIOR ART

R1<<R2

THERMOSTAT

RELATED APPLICATION

This application is a nationalization under 35 U.S.C. 371 of PCT/JP2006/301252, filed Jan. 26, 2006 and published as WO 2006/082749 A1 on Aug. 10, 2006, which claimed priority under U.S.C. 119 to Japanese Application No. 2005-027101, filed Feb. 2, 2005, which applications and publication are incorporated herein by reference and made a part hereof.

TECHNICAL FIELD

The present invention relates to a thermostat for controlling the heating temperature of a ceramic heater.

BACKGROUND ART

A bimetal thermoswitch employing a ceramic substrate has been proposed in the past as an insulating support for a thermostat (see, for example, Patent Document 1).

FIG. 1A is a side view showing an example of such a bimetal thermoswitch employing a conventional ceramic substrate as an insulating support for a thermostat, FIG. 1B is a top view of the bimetal thermoswitch shown in FIG. 1A, and FIG. 1C is a back view of the bimetal thermoswitch shown in FIG. 1A.

The bimetal thermoswitch comprises a thin and rectangular support 1 made of alumina ceramic, as shown in FIG. 1A, FIG. 1B and FIG. 1C. A groove 2 is formed in the center of the support 1, and both of the longitudinal ends of a basal surface 1*a* are metalized.

Terminal tabs 3 and 4 are fixed on either of the metalized longitudinal ends of the support 1.

The terminal tabs 3 and 4 have a soldering hole 5 on one end, another end is divided into three parts in a fork-like form, and a pair of protrusions 6 on both sides of the fork and protrusion 7 in the middle are formed in a manner such that they are at different levels. The pair of protrusions 6 at the lower level is joined to the metalized end of the basal surface 1*a* of the support 1, and the protrusion 7 at the upper level is simply connected to the superior surface of the support 1.

A contact spring 8 has a hole 11 in the approximate center, and a plastic pin 12 is inserted into the hole 11. A head 13 of the pin 12 is caught at the top surface of the contact spring 8, and the lower rod point of the pin 12 penetrates a hole 14 that is provided in the center of a bimetal plate 15 and the groove 2 of the support 1.

The bimetal plate 15 lies between the support 1 and the contact spring 8. A collar 16 of the pin 12 that lies between the contact spring 8 and the bimetal plate 15 serves as a spacer and produces a heat insulating effect between the contact spring 8 and the bimetal plate 15.

A film resistance 17 is placed on the basal plane 1*a* of the support 1. The film resistance 17 is electrically connected to the terminal tabs 3 and 4 via a conductive strip 18.

When the bimetal plate bends in the opposite direction in response to the higher than switching temperature and lifts up the contact spring 8, electrical current flows only via the film resistance 17, consequently heating the support 1, and the bimetal plate 15 is heated via the support 1. This prevents the bimetal plate 15 from causing a return movement to the initial position where the bimetal plate 15 closes the switch.

As explained above, because the collar 16 of the pin 12 serves as a spacer and produces a heat insulating effect between the contact spring 8 and the bimetal spring 15, the bimetal plate 15 is hardly influenced by Joule heat generated in the contact spring 8.

In the technology in Patent Document 1, it is assumed that the heat source for operating a bimetal thermoswitch (hereinafter referred to as a thermostat) is provided externally, or in other words that the bimetal thermoswitch itself is used as a thermostat, and has a configuration for sensing the external hot air.

However, when a thermostat with a configuration such as that in Patent Document 1 is used for the purpose of the temperature control of a hot plate type heater that has been incorporated into a hair iron or other such device, or for the purpose of the protection of the hot plate type heater by preventing overheating, heat sensing may not function properly due to low thermal responsiveness, and may consequently cause a safety problem.

The thermostat may also be consisted of a large number of components which require many welding and soldering operations to be performed in order to engage each other, and the complex configuration may requires a lot of time and effort for assembly.

Patent Document 1: National Publication of Translated Version No. 63-501833

DISCLOSURE OF INVENTION

In view of the above problems in the conventional technology, it is an object of the present invention to provide an inexpensive and easy-to-assemble thermostat composed of a minimum number of parts and exhibiting good heat detection response, especially when it is employed in a hot plate type heater.

The thermostat of the present invention has a fixed contact on an insulating plate and a movable plate that has a moving contact at a position that faces the fixed contact. The movable plate opens and closes an external electrical circuit connected to the fixed contact and the moving contact by counter turn responsive to a bimetal that counter turn at a prescribed temperature. The movable plate comprises as a single unit a spring point for pressing the moving contact onto the fixed contact with a prescribed contact force, a fixation point provided in a securing plate connected in series with the spring point for securing the movable plate on the insulating plate, a supporting point for supporting the bimetal, and a terminal point for connecting the external electrical circuit.

In the thermostat, the insulating plate may comprise, for example, a ceramic plate insulator and the fixation point may comprise, for example, two hooks with a U-shaped spring property formed by bending each of the parts extended from both sides of the securing plate. In addition, the moving contact can be provided, for example, on the distal end of the spring point, the spring point can be formed by, for example, bending a root connected in series with the securing plate in a U-shape, and the bimetal can be placed, for example, between the spring point and the fixation point.

In the thermostat, the supporting point can be formed, for example, in a pin-shape by bending each of the rear extended points of the securing plate at a right angle, and this supporting point can support the bimetal by inserting it through a hole provided in the center of the bimetal. It can be formed so that the distal end of the pin-shape protrudes outward from the hole provided on the bimetal when the moving contact is in contact with the fixed contact. In such a case, it is preferable that the supporting point be formed by bending it at a bending angle of at least 15 degrees in the longitudinal direction of the supporting point at the center of the pin-shape.

In the thermostat, the supporting point can be formed, for example, at least three points on the securing plate by at least two nail points formed by setting up a part of the securing plate and the root of the spring point. These supporting points would then support the bimetal from the side surface, and the distal end of the nail point can be formed so as to be at a position higher than the spring point when the contact between the moving contact and the fixed contact is canceled. In addition, the terminal point can be secured with the insulating plate via a hole provided in a terminal point of the insulating plate.

In addition, in the thermostat, the insulating plate can be, for example, a ceramic substrate of a ceramic substrate type heater, and the terminal point of the movable plate by being electrically connected to one of electrodes incorporated in the heater and by being secured on the ceramic substrate, can be connected in series with the heater and can adjust the heating temperature of the heater.

In any of the above configurations of the thermostat, the movable plate may comprise, for example, a blade point for pressing the bimetal onto a surface of the insulating plate of a part of the spring point.

EXPLANATION OF THE CODES

Figure 1A:
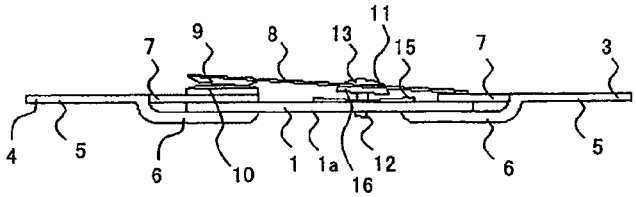
FIG. 1A A side view showing an example of a bimetal thermoswitch employing a conventional ceramic substrate as an insulating support for a thermostat.
Figure 1B:
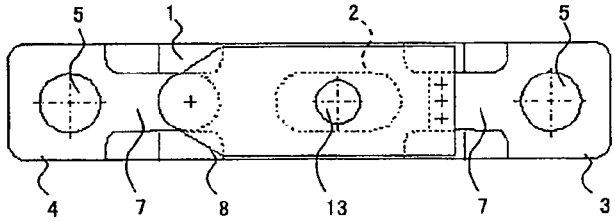
FIG. 1B A top view of the bimetal thermoswitch shown in FIG. 1A.
Figure 1C:
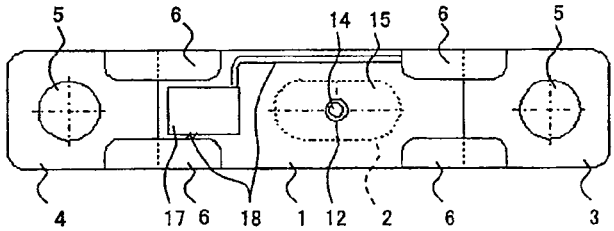
FIG. 1C A back view of the bimetal thermoswitch shown in FIG. 1A.

1 support
1*a* basal surface
2 groove
3,4 terminal tabs
5 soldering hole
6 pair of protrusions
7 center protrusion
8 contact spring
9 moving contact
10 fixed contact
11 hole
12 plastic pin
13 pin head
14 hole
15 bimetal plate
16 collar
17 film resistance
18 conductive strip
20 movable plate
21 moving contact
22 spring point
23 securing plate
24(24-1,24-2) securing point
25 supporting point
26 terminal point
27 oval convex
28 rectangular convex
29 round hole for supporting point
31, 32(32-1,32-2) 33, 34, 35 fold points
36 step-like-point
37 ceramic substrate type heater
38 upper ceramic plate
39 lower ceramic plate
41 adhesive agent
42 hole for connection
43 hole for connecting operation
44 back side
45 wire
46 electrodes
47 lead wire
48 wire
49 electrodes
R1 main heater circuit
R2 bimetal maintaining circuit
51 fixed contact
52 soldering
53, 54 wire
55 electrodes
56 lead wire
57 lead coating
58 thermostat
59 bimetal
61 thermostat
62 extended point
63 nailed point
64 bimetal
65(65-1, 65-2) terminal for external connection
66 rivet (or metal eyelet)
67 thermostat

68 blade point

70 thermostat

71 insulating plate

72 gripping point

73 holding point

BEST MODE FOR CARRYING OUT THE INVENTION

Embodiment 1

Figure 2:
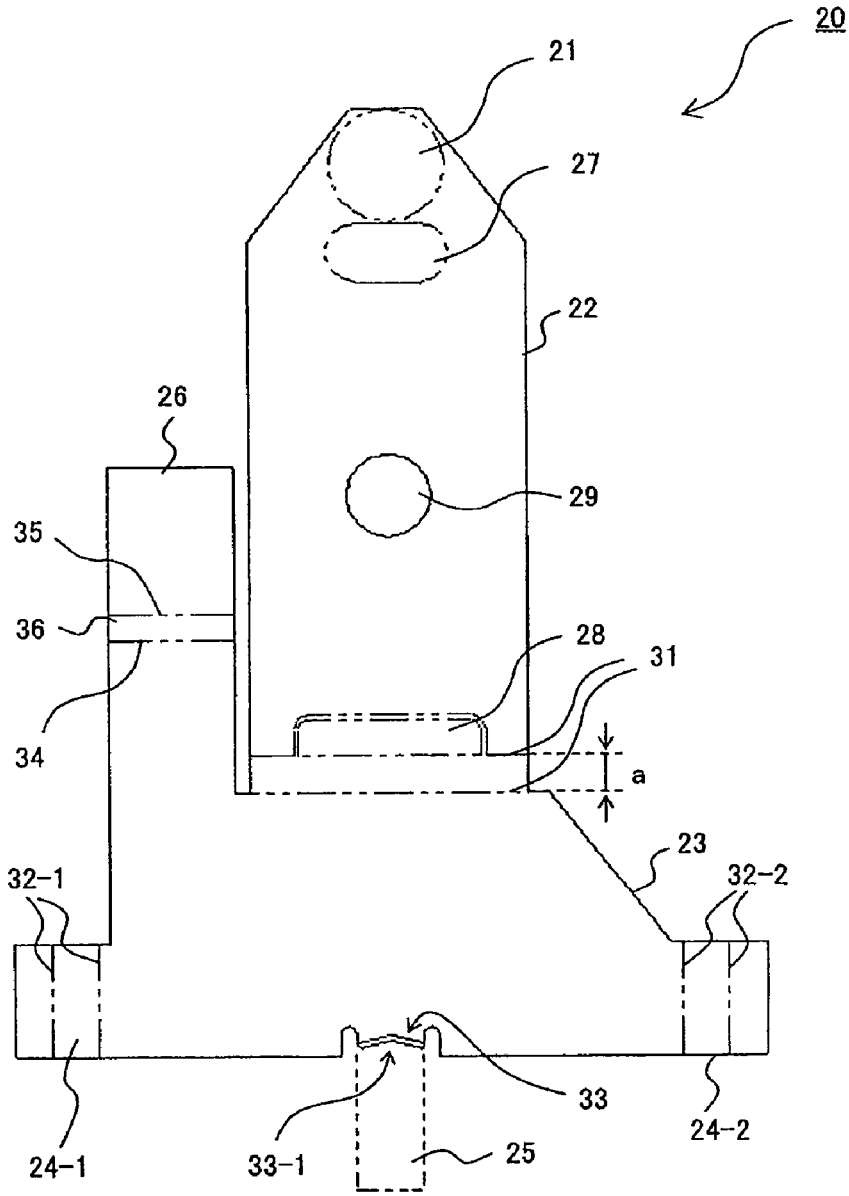
FIG. 2 An expanded top view of a movable plate constituting the thermostat of the first embodiment.

FIG. 2 is an expanded top view of a movable plate constituting the thermostat of the first embodiment. The movable plate 20 comprises a moving contact 21 at a position that faces a fixed contact provided on an insulating plate explained later, is driven by a bimetal that counter turns at a certain temperature, and is used for a thermostat, which opens and closes the external electrical circuit connected to the fixed contact and the moving contact 21, described later.

The movable plate 20, as shown in FIG. 2, comprises as a unit a spring point 22 having a moving contact 21 at its end, a securing point 24 (24-1, 24-2) formed on a securing plate 23 that is connected in series with the spring point 22, a supporting point 25, and a terminal point 26.

It should be noted that since FIG. 2 is an expanded view, each of the above points is shown in an expanded form; however the points are named same names as the points after being assembled.

The movable plate 20 can be obtained from a single spring material processed by punching it out and bending it with a press.

For example, the spring point 22 of the movable plate 20, when the moving contact 21 is attached to the end via welding or caulking and when it is bent into a U-shape, can be formed so as to have a bias force that brings the moving contact 21 attached to its end into contact with a fixed contact, explained later, using a certain contact force.

The securing point 24 forms a securing point for securing the movable plate 20 on an insulating plate, explained later. The supporting point 25 supports a bimetal, explained later. In the present embodiment, the terminal point 26 is connected to an external power supply circuit for a heating insulation plate, explained later.

For the movable plate 20 in the expanded view shown in FIG. 2, the moving contact 21 is first attached to the end of the spring point 22 by welding or caulking as explained above, and next, an oval convex 27 is pushed from the back side (opposite side of the drawing), and formed at a position under the moving contact 21. Additionally, a rectangular convex 28 is formed by pushing from the back side at a position where a prescribed space is provided from a root that is connected in series with the securing plate 23.

In addition, a round hole for supporting point 29 is creating by, for example, punching a hole in the center of the spring point 22. Note that the hole for supporting point 29 is not limited to being a round hole; it may be an oblong hole.

The spring point 22 is valley-folded at approximately a right angle at a fold point 31 at two points: the point where the root is connected in series with the securing plate 23 and a point immediately below the rectangular convex 28. In other words, the spring point 22 is formed by being bent so that the cross-section from the securing plate to the root of the extended part is U-shaped (to be exact, the fold point has an angular U-shape).

As a result, the spring point 22 is arranged so as to face the securing plate 23 across the space a. As explained later, a bimetal is placed between the spring point 22 and the securing plate 23.

In advance of bending the spring point 22, extended points of both sides in the rear, namely, the securing points 24 (24-1, 24-2), are mountain-folded at two fold points 32 (32-1, 32-2), respectively, in the securing plate 23, so that a U-shaped hook (to be exact, an angular U-shape with an upward opening) with the property of springiness is formed at two points.

The ceramic substrate of a ceramic substrate type heater in the present embodiment (hereinafter referred to as an insulating plate) is inserted between the securing points 24 (24-1, 24-2) of a hook shape with the spring property formed at two points via a sliding method, and the movable plate 20 is incorporated into an insulating plate in a state in which the movable plate 20 holds the insulating plate at the securing points 24 on the rear side of the paper in FIG. 2. The movable plate 20 is secured on the insulating plate (the ceramic substrate of the ceramic substrate type heater), as explained later, by connecting the terminal point to one terminal of the ceramic substrate type heater by welding etc.

It should be noted that it is also possible to secure the movable plate 20 on the insulating plate by, first, bending the securing points 24 to form an L-shape and mounting the securing plate 23 on the insulating plate, and then by further bending the end of the L-shape to the back side of the insulating plate, rather than by forming a hook with the property of springiness by bending the securing points 24 to form a U-shape at the beginning.

A stopper form may be employed in which notches are made at points on an insulating plate corresponding to the securing points so that the supporting point is engaged to and secured on the notch.

In addition, in the securing plate 23 of the present embodiment, the supporting point 25 formed at the rear extended part is valley-folded at a fold point 33 and formed into a pin-shape. The supporting point 25 formed into a pin-shape supports a bimetal by penetrating a hole provided in the center of the bimetal attached between the spring point 22 and the securing plate 23.

In order to enhance the stiffness, the pin-shaped supporting point 25 may be, for example, bent along the longitudinal direction at the center 33-1 and entire structure may have a ribbed shape.

In this situation, it is preferable to have a bending angle of at least 15 degrees, and in such a case, its cross-section should be V-shaped or U-shaped. As a result, the strength is increased to greater than that of a flat plate simply being bent, and stable support of the bimetal can be achieved.

The distal end of the pin-shaped support 25, when the moving contact 21 is in contact with the fixed contact explained later, is formed so as to project outward from a hole provided on the bimetal. The hole provided on the bimetal may be round, or may be oval or polygonal; it is not represented in the drawing in any particular preferred shape.

It should be noted that a round hole for supporting point 29 formed in the center of the spring point 22 is provided in order to protect it from the distal end of the pin-shaped supporting point 25 that projects outward from the hole of the bimetal.

The terminal point 26 of the securing plate 23 is formed extending from one side of the securing plate 23 and is in parallel with the spring point 22 and is formed at two folded points 34 and 35 approximately in the center of the extended point. A step-like point 36 is formed between the folded points 34 and 35 by loosely mountain-folding at folded point 34 and by loosely valley-folding at folded point 35.

The distal end of the terminal point 26 from the step-like point 36 is connected to one terminal of an external electrical circuit explained later; namely, a ceramic substrate type heater.

Figure 3A:
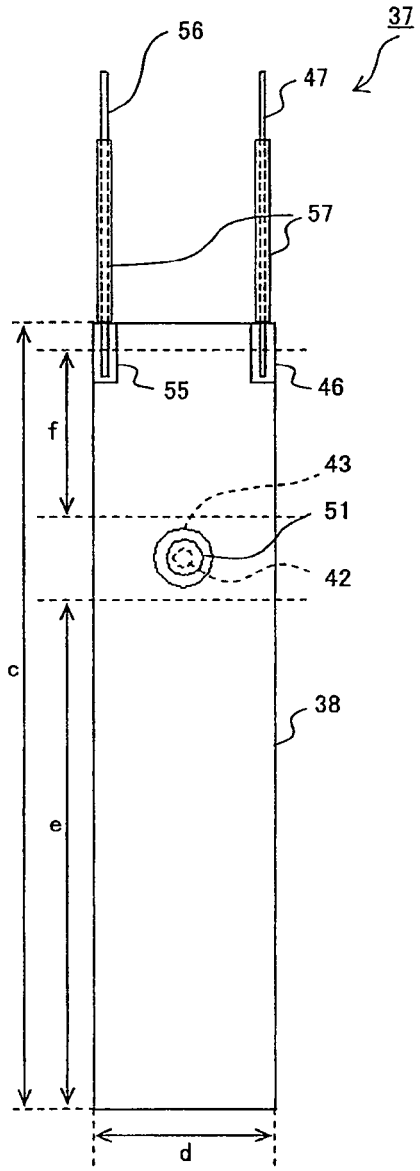
FIG. 3A A top view of the ceramic substrate heater in the first embodiment.
Figure 3B:
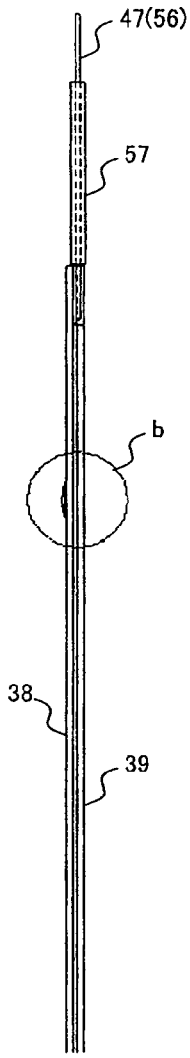
FIG. 3B A side view of the ceramic substrate heater shown in FIG. 3A.
Figure 3C:
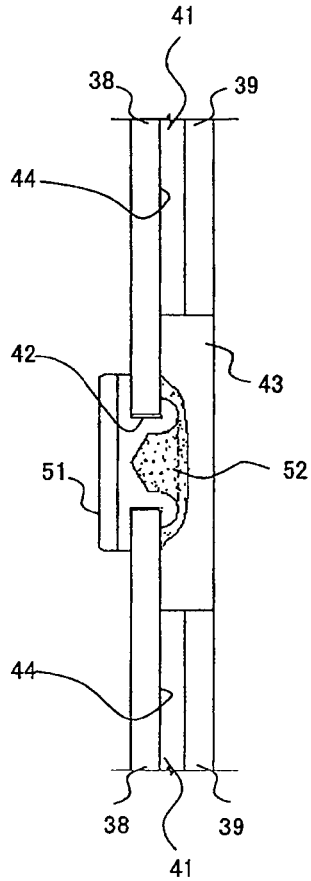
FIG. 3C An enlarged view of a part designated by a circle b in FIG. 3B.

FIG. 3A is a top view of the ceramic substrate heater in the present embodiment, FIG. 3B is its side view and FIG. 3C is an enlarged view of a point designated by the circle b in FIG. 3B.

Figure 4:
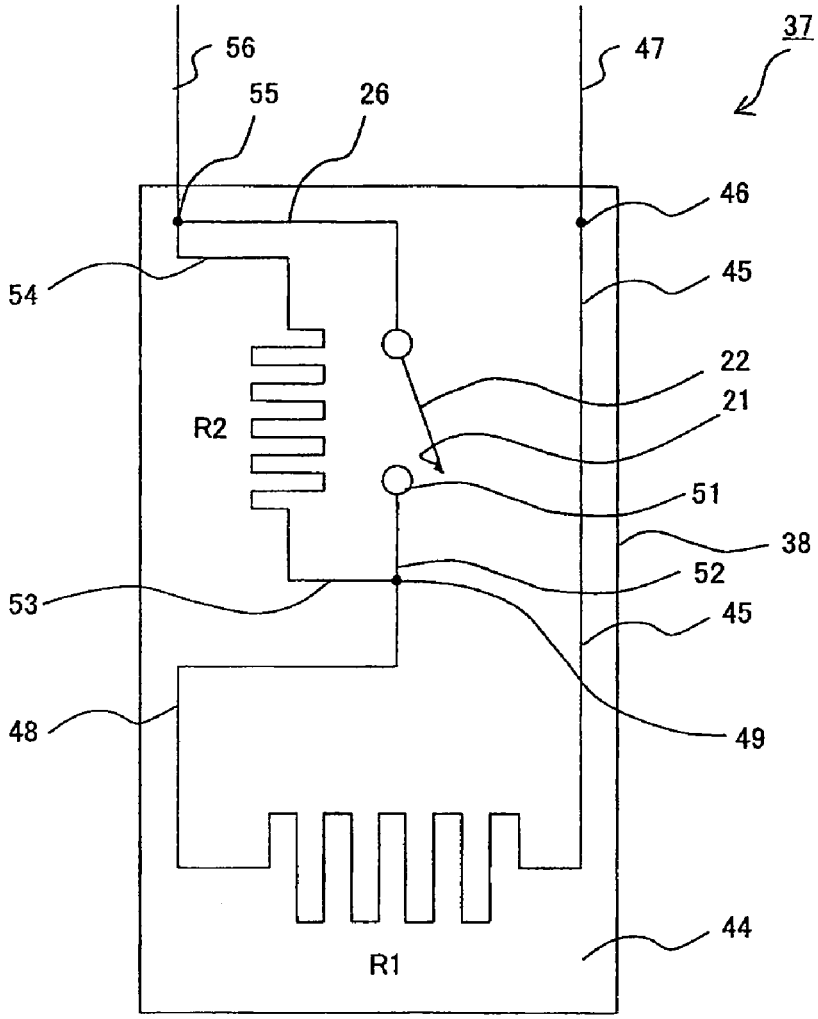
FIG. 4 A schematic diagram showing a heater circuit printed inside the ceramic substrate type heater.

FIG. 4 is a schematic diagram showing a heater circuit printed inside the ceramic substrate type heater. Note that in FIG. 4, components with the same functions as those in FIG. 2, FIG. 3A, FIG. 3B, and FIG. 3C are designated with the same numerical reference as FIG. 2, FIG. 3A, FIG. 3B and FIG. 3C.

The ceramic substrate type heater 37 shown in FIG. 3A, FIG. 3B, FIG. 3C and FIG. 4 is a hot plate type heater used, for example, in hair irons, and the dimension c in the longitudinal direction in FIG. 3A is 70 mm, as an example, and the dimension d in the width direction is 15 mm, as an example.

In the ceramic substrate heater 37, as shown in FIG. 3A, FIG. 3B, and FIG. 3C, an upper ceramic plate 38 and a lower ceramic plate 39 are adhered by an adhesive agent 41. The upper ceramic plate 38 has a small hole for connection 42 formed at a position ¼ lower than the top end (upper end in the drawing), and the lower ceramic plate 39 has a large hole for connecting operation 43 at a position opposite to the hole for connection 42.

On the back side 44 in contact with the adhesive agent 41 of the upper ceramic plate 38, as shown in FIG. 4, two heater circuits, a main heater circuit R1 and a bimetal maintaining circuit R2, are formed by printing.

The main heater circuit R1 is formed in a part designated as the range e in FIG. 3A, and the bimetal maintaining circuit R2 is formed in a part designated as the range f in FIG. 3A. The relation between the resistance value R1 of the main heater circuit R1 and the resistance value R2 of the bimetal maintaining circuit R2 is "R1<<R2".

One terminal of the main heater circuit R1 is connected to an electrode 46 via wire 45, and a lead wire 47 is connected to the electrode 46, by soldering for example. Another terminal of the main heater circuit R1 is connected to an electrode 49 via wire 48, and the electrode 49 is connected to a fixed contact 51. This connection is made via the hole for connecting operation 43 shown in FIG. 3A and FIG. 3C. Via the connecting operation, the fixed contact 51 is connected to the electrode 49 via the hole for connection 42, by soldering 52 for example.

On the other hand, one terminal of the bimetal maintaining circuit R2 is connected to electrode 49 via wire 53 and another terminal is connected to electrode 55 via wire 54. A lead wire 56 is connected to the electrode 55, by soldering for example.

The terminal point 26 of the securing plate 23 is connected to and secured on the lead wire 56 by caulking or welding.

In addition, the lead wires 47 and 56 in the present embodiment are coated with a lead coating 57 on all portions except the free terminal part and the part connected to the electrodes 46 and 55, as show in FIG. 3A and FIG. 3B.

It should be noted that the ceramic substrate type heater 37 has a heating portion that was attained by forming an inside conductor pattern, shown in FIG. 4, via printing or another such method on at least one of the two ceramic plates serving as insulating plates (the upper ceramic plate 38 and the lower ceramic plate 39). In such a case, it is possible for the terminal point conducting an external power source to be used as the terminal point of the heater.

According to the present embodiment, in the internal heater circuit unit, a bimetal maintaining circuit R2 independent from the main heater circuit R1 is provided between the terminal point 26 and a fixed contact 51 of the movable plate, or in other words, in parallel with the part blocked by the thermostat; however, it is not limited to such a configuration.

Instead, only the main heater circuit R1 is needed when constructing a hot plate type heater thermostat used in a hair iron or other such device.

However, for constructing a general hot plate heater thermostat as shown in FIG. 4, if two heater circuits, the main heater circuit R1 and the bimetal maintaining circuit R2, are provided, a voltage is applied to the bimetal maintaining circuit R2 that is parallel to the thermostat after the circuit is blocked by the operation of the thermostat. At that time heat is generated, and the heat in the bimetal in the thermostat can be maintained.

As a result, once the thermostat begins operating, the bimetal maintaining circuit R2 keeps heating the bimetal as long as it is connected to the power source, and the power-blocked state can be maintained.

Additionally, depending on its usage, a possible configuration is such that by lowering the return movement temperature of the bimetal, the bimetal will not cause return movement at room temperature. In such a case, by cooling the bimetal to the return movement temperature (which is at room temperature or below) with blowing cold air, it is possible to force the return movement of the bimetal.

Figures 5A, 5B, 5C, 5D:
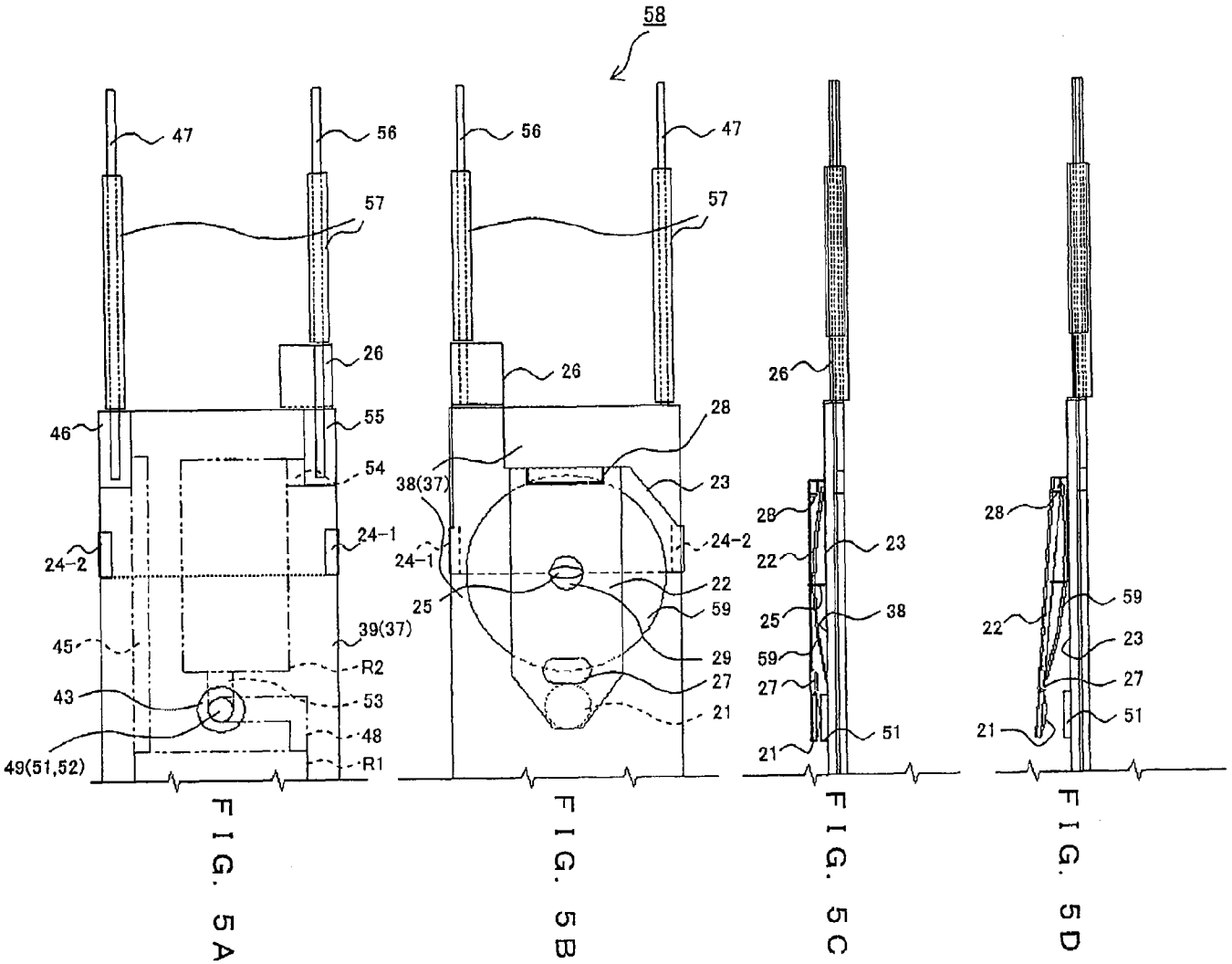
FIG. 5A A back view of the thermostat of the first embodiment that has been completed in such a manner so that the movable plate is incorporated into the ceramic substrate type heater and a bimetal is placed between the spring point and the securing plate.
FIG. 5B A back view of the thermostat shown in FIG. 5A.
FIG. 5C A side cross-sectional view of FIG. 5B.
FIG. 5D A side cross-sectional view of FIG. 5B.

FIG. 5A is a back view of the thermostat of the present embodiment in which the movable plate 20 formed as explained in FIG. 2 is incorporated into the ceramic substrate type heater 37 shown in FIG. 3A, FIG. 3B, and FIG. 3C, and a bimetal is placed between the spring point 22 and the securing plate 23; FIG. 5B shows a top view and FIG. 5C and FIG. 5D show side cross-sectional views.

It should be noted that in FIG. 5A, FIG. 5B, FIG. 5C and FIG. 5D, depiction of a large part of the range e shown in FIG. 3A where the main heater circuit R1 is placed is omitted except for the upper end part of the main heater circuit R1, as shown in FIG. 5A. In FIG. 5A, FIG. 5B, FIG. 5C and FIG. 5D, the same components as those in the configurations in FIG. 2 through FIG. 4 are designated with the same numerical reference as those in FIG. 2 through FIG. 4.

As shown in FIG. 5A and FIG. 5B, the securing points 24 (24-1, 24-2) formed on the securing plate 23 secure the movable plate 20 on the ceramic substrate type heater 37 by sandwiching, from the top and bottom, the upper ceramic plate 38 and the lower ceramic plate 39 serving as a plate insulator.

The thermostat 58 of the present embodiment has an approximately round bimetal 59 between the spring point 22 and the securing plate 23. The bimetal 59 has convex warpage from the front side of the drawing of FIG. 5B when the sensing temperature is a prescribed temperature that is at room temperature or below. FIG. 5C shows such a state.

The prescribed temperature is, in the case of a hair iron, for example, defined as a high temperature that does not burn hair.

At the prescribed temperature or below, the bimetal 59 has convex warpage to the side of the spring point 22, as shown in FIG. 5C, and in this state, an upper surrounding part of the bimetal 59 is in contact with the securing plate 23 of the movable plate 20, and a lower surrounding part is in contact with the upper ceramic plate 38 of the ceramic substrate type heater 37.

In such a state, also, the bimetal 59 is constructed so as to be at a position where the approximately round surrounding part is away from the spring point 22.

As a result, the moving contact 21 provided to the distal end of the spring point 22 is biased in the direction of the ceramic substrate type heater 37 by the spring property of the spring point 22, and is welded with pressure to the fixed contact 51 shown in FIG. 3C formed on the upper ceramic plate 38.

In other words, in the thermostat 58 of the present embodiment, the moving contact 21 and the fixed contact 51 are in contact at a prescribed temperature or below, and because of the relation of "R1<<R2" as explained in FIG. 4, the current supplied from the external power source to the ceramic substrate type heater 37 via the leads 47 and 56 flows only very slightly in the bimetal maintaining circuit R2 shown in FIG. 4, and flows in the main heater circuit R1 via the moving contact 21 and the fixed contact 51. As a result, the main heater circuit R1 generates heat. In other words, the ceramic substrate type heater 37 generates heat.

The movable plate 20 is configured by, for example, a piece of sheet iron that has the property of springiness and favorable heat conductivity, and thus bimetal 59 has heat generated by the ceramic substrate type heater 37 directly and promptly conducted via the securing plate 23.

When the sensing temperate of the bimetal 59 exceeds a prescribed temperature, the bimetal 59 bends in the opposite direction and becomes concave in relation to the front side of the drawing in FIG. 5B. FIG. 5D shows such a state.

In FIG. 5D, the bimetal 59 has its upper end pinned to the securing plate 23 by a rectangular convex 28. Therefore, the bimetal 59 being concave with respect to the spring plate 22 is brought into contact with the securing plate 23 in the proximity of the center of the concave in the back side (convex in the back side view), and the whole bimetal has concave warpage having the contact point serving as a supporting point.

As a result, a lower end located on the opposite side of the pinning by the rectangular convex 28 with respect to the supporting point of the bimetal 59 in FIG. 5B springs out to the spring plate 22 side, and is in contact with the oval convex 27 of the spring point 22, and additionally pushes out the convex 27 in the direction of the spring plate 22. As a result, the power switch of the moving contact 21 and the fixed contact 51 is opened.

In FIG. 4, when the moving contact 21 and the fixed contact 51 are not in contact, in the current supplied from the external power source to the ceramic substrate type heater 37 via the lead wires 47 and 56, the partial voltage between wires 53 and 54 is far higher than the partial voltage between wires 48 and 45 because of the relation of "R1<<R2" as explained above. As a result, the current consumption is reduced in the main heater circuit R1, and the reduced amount is consumed by the bimetal maintaining circuit R2. In other words, the bimetal maintaining circuit R2 generates heat.

Consequently, the bimetal 59 is heated via the upper ceramic plate 38 and the securing plate 23. As a result, the return movement of the bimetal 59 to the position where the power source switch comprising the moving contact 21 and the fixed contact 51 is closed can be controlled, and the concave warpage state of the bimetal 59 is maintained until certain conditions can be met.

Embodiment 2

Figures 6A, 6B, 6C:
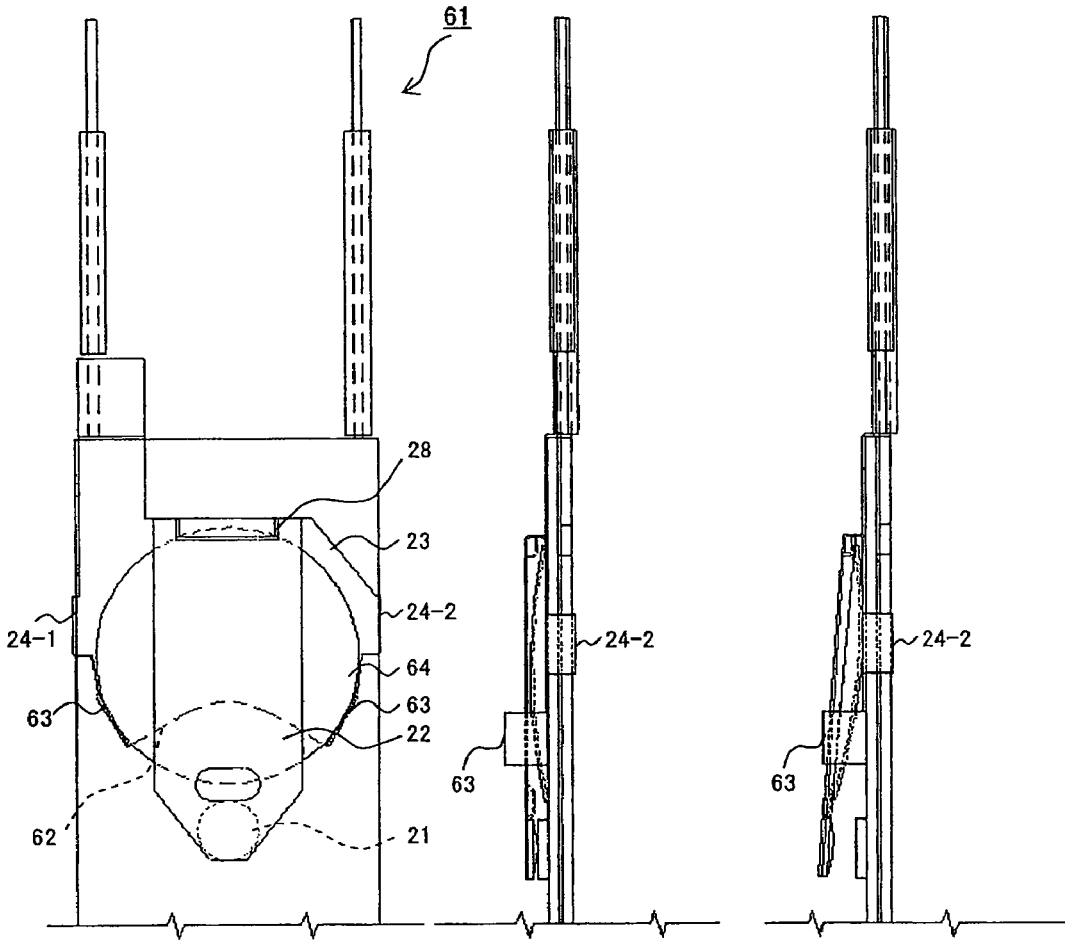
FIG. 6A A top view showing the configuration of the supporting point of the movable plate constituting the thermostat of the second embodiment.
FIG. 6B A side cross-sectional view of FIG. 6A.
FIG. 6C A side cross-sectional view of FIG. 6A.

FIG. 6A is a top view showing the configuration of the supporting point of the movable plate constituting the thermostat of the second embodiment, and FIG. 6B and FIG. 6C are its side cross-sectional views. Note that in the following description, the components that are the same as those in the first embodiment are designated with the same numerical references as those of the first embodiment for parts where an explanation is necessary in the second embodiment, and for parts where the explanation is unnecessary in the second embodiment, the designation of the numerical reference and explanation are omitted.

As shown in FIG. 6A, FIG. 6B and FIG. 6C, the thermostat 61 of the present embodiment does not comprise a supporting point 25 for positioning and supporting a bimetal shown in the first embodiment, and instead of the supporting point 25, the back ends of the securing plate 23 are extended and nailed points 63 formed by setting up both ends of the extended point 62 are formed at least two points.

The bimetal 64 of the present embodiment is positioned and supported by the two nailed points 63 and the rectangular convex 28. The distal ends of the nailed points 63 are formed so as to be at a position higher than the spring point 22 of the movable plate 23 when the contact between the moving contact 21 and the fixed contact 51 (not shown in the drawing) is canceled, that is, when the spring point 22 is located the most distant from the securing plate 23.

As a result, the bimetal 64 placed between the spring point 22 and the securing plate 23 is supported by the nailed points 63 and does not fall off at any time.

As described above, the supporting point for the bimetal may take the form of a configuration, without making a hole in the bimetal, for supporting the side surface of the bimetal at least three points, including an internal part of the U-shaped bend at the root of the spring point 22 and parts where the extended points of the securing plate 23 are set up at a right angle.

It should be noted that in the present embodiment, the functions and effects of the bimetal 63, the spring point 62, and the moving contact 21 are the same as those in the bimetal 59, the spring point 22, and the moving contact 21, respectively, in the first embodiment explained in FIG. 5A through FIG. 5D.

Embodiment 3

Figure 7A:
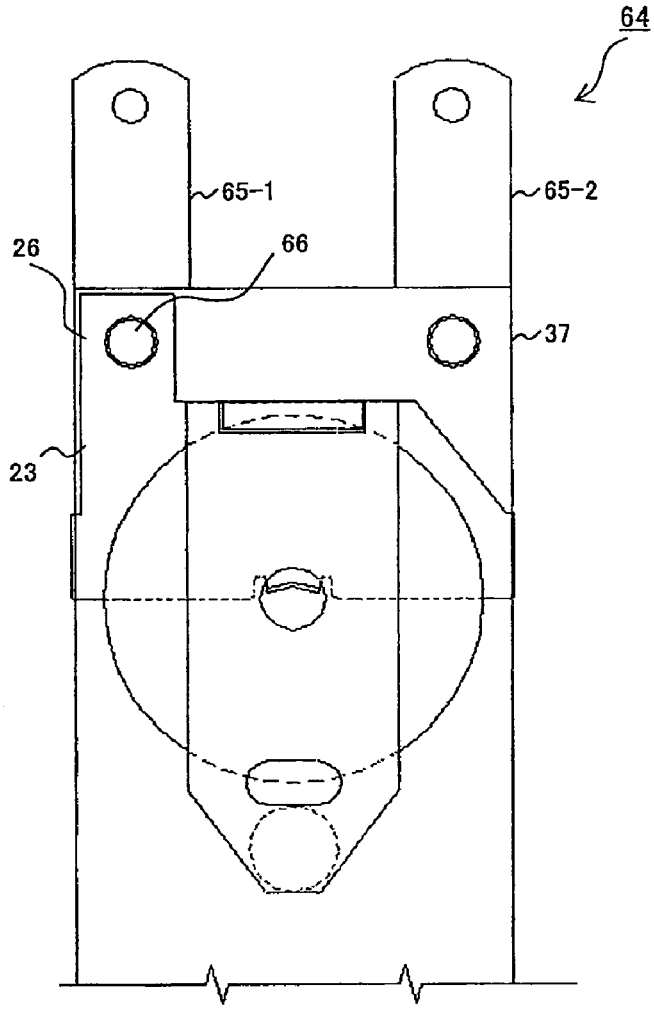
FIG. 7A A top view showing the configuration of the supporting point of the movable plate constituting the thermostat of the third embodiment.
Figure 7B:
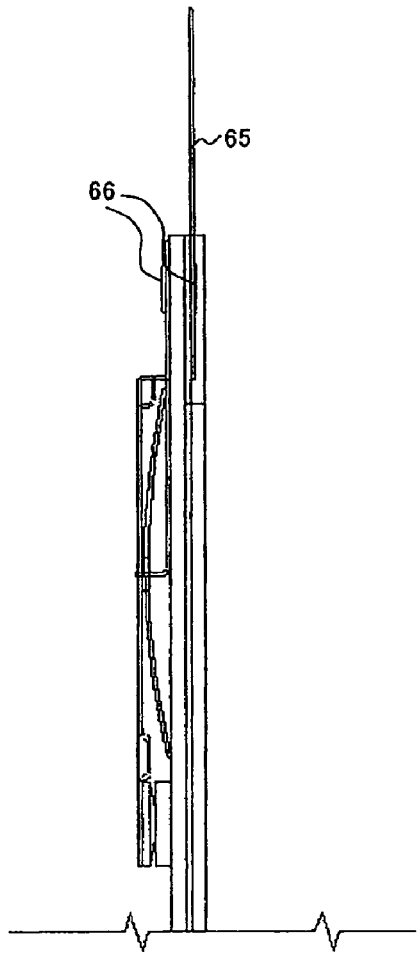
FIG. 7B A side cross-sectional view.

FIG. 7A is a top view showing the configuration of the supporting point of the movable plate constituting the thermostat of the third embodiment, and FIG. 7B is its side cross-sectional view.

Note that in the following description of the present embodiment as well, the components that are the same as those of the first embodiment explained above are shown with the same numerical references as the first embodiment for parts where an explanation is necessary for the third embodiment, and for parts where the explanation is not necessary for the third embodiment, the designation of the numerical reference and the explanation are omitted.

The thermostat 64 in the present embodiment as shown in FIG. 7A and FIG. 7B has a configuration in which the lead wires 47 and 56 shown in the first embodiment are not pull out from the ceramic substrate type heater.

In such a case, a hole is formed on the insulating plate, and the terminal point 26 of the securing plate 23 as well as either one of two terminals for external connection 65 (65-1, 65-2) (65-1 is selected in FIG. 7A) is caulked and fixed with rivet (or metal eyelet) 66 or another such fastener.

It should be noted that the configuration other than the configuration of the two terminals for external connection 65 (65-1, 65-2) and the rivet (or metal eyelet) 66 that caulks and fixes the terminal point 26 with one of the terminals for external connection 65 are the same as the configuration of the first embodiment shown in FIG. 5A and FIG. 5B, and the function and effect of the bimetal 59, the spring point 22, and the moving contact 21 are also the same as those in the first embodiment.

Embodiment 4

Figures 8A, 8B, 8C:
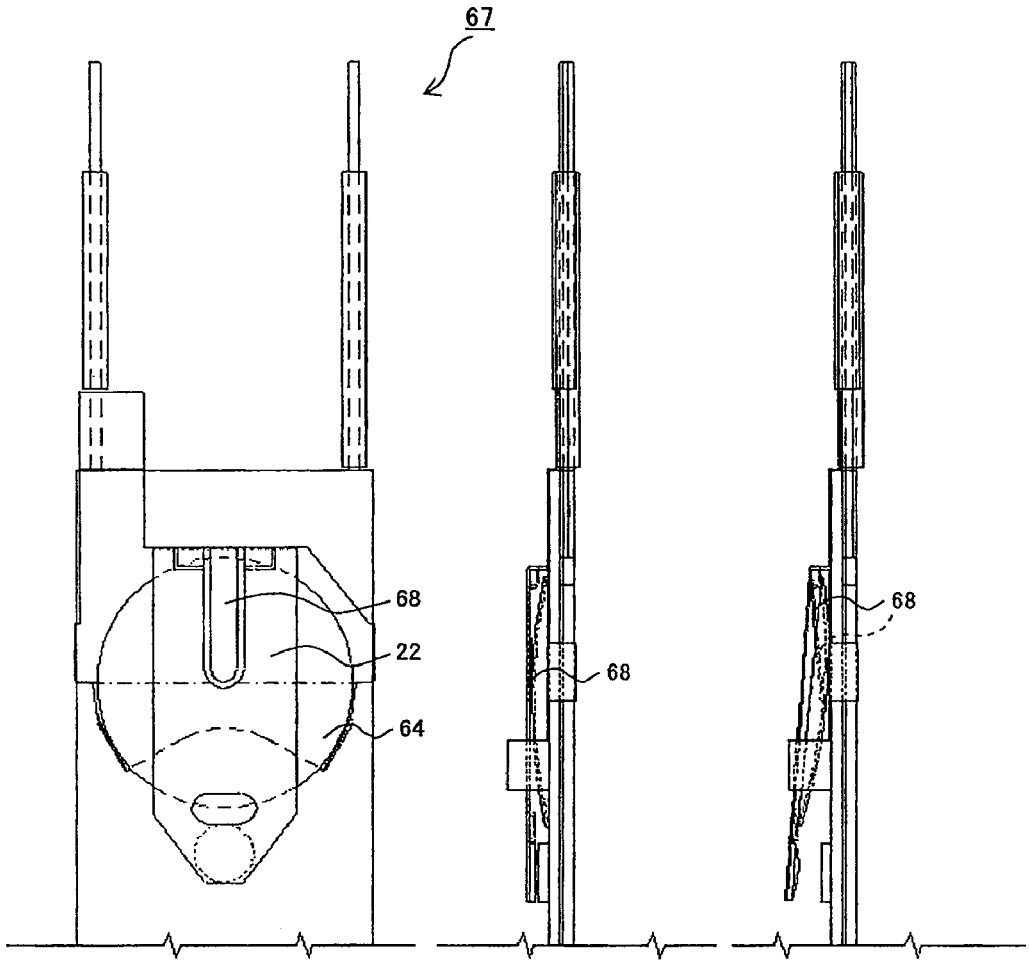
FIG. 8A A top view showing the configuration of the supporting point of the movable plate constituting the thermostat in the fourth embodiment.
FIG. 8B A side view of FIG. 8A.
FIG. 8C A side view of FIG. 8A.

FIG. 8A is a top view showing the configuration of the supporting point of the movable plate constituting the thermostat in the fourth embodiment, and FIG. 8B and FIG. 8C are its side view. Note that the present embodiment has a configuration that can be an example of a modification of the configuration of the thermostat of the second embodiment shown in FIG. 6A through FIG. 6C. Therefore, in the following description, the configuration of the second embodiment should be referred to for parts other than the part where an explanation is necessary and the numerical reference and the explanation are omitted.

In the thermostat 67 of the present embodiment, as shown in FIG. 8A through FIG. 8C, a blade point 68 is created by clipping of the center part along the longitudinal direction of the spring point 22 from the root of the spring point 22 to the position corresponding to the center of the bimetal 64.

As a result, the center part of the bimetal 64, being convex with respect to the front side of the drawing (that is, with respect to the blade point 68 side), is pressed by the blade point 68 at room temperature, and consequently the surrounding part of the bimetal 64 can be in contact with the heater surface without much looseness.

The heat conductivity to the bimetal 64 is ensured as a result of the above process, and the heat on the heater surface can be effectively sensed by the bimetal 64. Consequently, the bimetal response can be further improved.

Embodiment 5

Figures 9A, 9B, 9C:
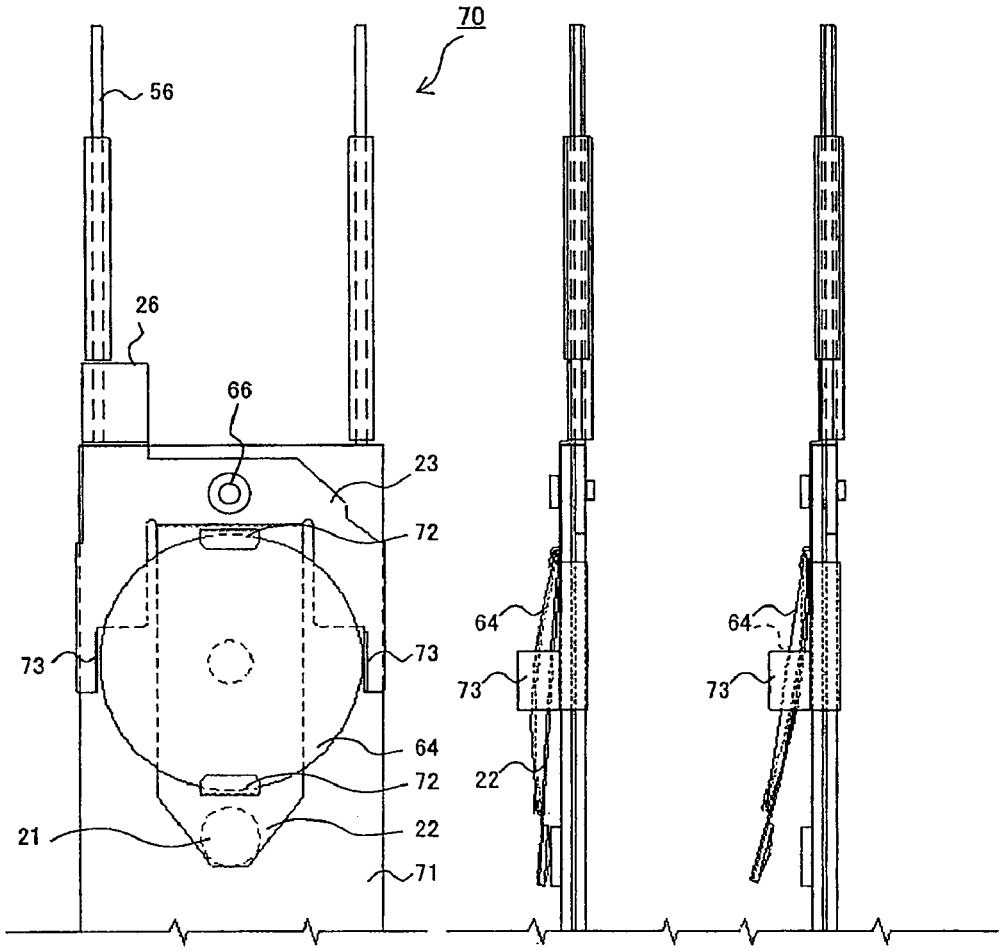
FIG. 9A A top view showing the configuration of the securing point and the supporting point of the movable plate constituting the thermostat in the fifth embodiment.
FIG. 9B A side view of FIG. 9A.
FIG. 9C A side view of FIG. 9A.

FIG. 9A is a top view showing the configuration of the securing point and the supporting point of the movable plate constituting the thermostat in the fifth embodiment, and FIG. 9B and FIG. 9C are its side views. Note that in the following description of the present embodiment, the components that are the same as the components in the above first through third embodiments are designated with the same numerical reference, and for parts where an explanation is unnecessary the designation of the numerical references and the explanation are omitted.

In a thermostat 70 of the present embodiment, as shown in FIG. 9A through FIG. 9C, the shape of the securing point 24 used for securing the securing plate 23 to an insulating plate 71 is formed so as to have a longer side surface in the longitudinal direction along with the side surface of the insulating plate 71 than that in the case of the first through third embodiments.

The bimetal 64 of the present embodiment is not held between the insulating plate and the spring point by being in contact with an insulating plate such as the upper ceramic plate 38 (the insulating plate 71 in FIG. 9A) or the securing plate 23 as in the cases of thermostats 58, 61, or 64 in the first through third embodiments; however, in the present embodiment, it is mounted on the spring point 22, and is held by the spring point 22 and the securing plate 23.

In other words, at the root of the spring point 22 and in the proximity of the moving contact 21 at the distal end, point the top and bottom of the bimetal 64 are grasped by the spring point 22 by a grasping point 72 formed into a hook shape by cutting and bending it upright, and the sides of the bimetal 64 are held by the securing plate 23 by a holding point 73 formed into a screen-shape by cutting it upright on both ends of the securing plate 23.

In such a case, the bimetal 64 is convex with respect to the front side of the drawing at a prescribed temperature or below, and the moving contact 21 of the distal end of the spring point 22 is pressed onto the fixed contact formed on the insulating plate side 71. When the temperature exceeds the prescribed temperature, since the bimetal 64 counter turns to a concave shape with respect to the front side of the drawing with a supporting point of the grasping point 72 at the root of the spring point 22, the distal end of the spring point 22 pops up and the moving contact 21 departs from the fixed contact, and a conducting circuit between the two lead wires 56 is blocked.

In the thermostat 70 of the present embodiment, the insulating plate 71 may be a simple insulating plate, and does not necessarily have to be a ceramic substrate type heater. When it is a simple insulating plate, the bimetal 64 is configured so as to operate in response to the environmental temperature; for example, if the air temperature is high.

In any case, as shown in the first through fifth embodiments, the thermostat of the present invention has a securing plate and a spring point formed into one, and this is further combined with a holder of the insulating plate and the grasping point and holding point of the bimetal. This configuration is extremely simple, and it is therefore possible to provide a small, light, and inexpensive thermostat.

It is also possible to minimize the components when assembling a thermostat on an insulating plate, and as a result, an inexpensive thermostat can be provided.

It is also possible to incorporate a thermostat for each heater. In addition, it is possible to make each thermostat compatible with a hot-plate heat source having an insulating plate as a substrate type heat generator, and therefore, it is possible to provide a thermostat that has a simple configuration, is easy to assemble, and that can promptly detect heat.

Because of this ability to provide prompt heat detection, the present invention can contribute further to the improvement of safety.

Since a blade point that presses a bimetal onto the heater surface of a part of a movable plate comprising a moving contact is provided, it is possible to provide a thermostat with a favorable response in detecting heat in the heater, thereby contributing to the improvement of safety.

The invention claimed is:

1. A thermostat having a fixed contact on an insulating plate and a movable plate with a moving contact at a position that faces the fixed contact, and making/breaking an external electrical circuit connected to the fixed contact and the moving contact by driving the movable plate with a bimetal that counter turns at a prescribed temperature, wherein the movable plate comprises:

a spring unit for pressing the moving contact on the fixed contact with a prescribed contact force;

a securing plate connected in series with the spring unit;

the movable plate being formed into a U-shape by bending a root portion connected in series between the spring unit and the securing plate;

a securing unit for placing the bimetal between the spring unit and the securing plate, the securing unit forming a securing point provided on the securing plate connected in series with the spring unit for securing the movable plate on the insulating plate;

a supporting unit that is formed into a pin-shape by being bent about a fold point of the securing plate at a right angle, supports the bimetal by inserting the pin-shaped supporting unit through a hole provided in the center of the bimetal, and is formed so that the distal end of the pin-shaped supporting unit protrudes outward from the hole provided on the bimetal when the moving contact is in contact with the fixed contact;

a blade point that is part of the spring unit, the blade point for pressing the bimetal onto the surface of the insulating plate; and a terminal unit for connecting the external electrical circuit, and wherein the movable plate is comprised by a single plate.

2. The thermostat according to claim 1, wherein the insulating plate comprises a ceramic plate insulator, and a fixation unit comprises two hooks With a U-shaped spring property formed by bending each of one or more parts extended from both sides of the securing plate.

3. The thermostat according to claim 1, wherein the supporting unit is formed by at least three points on the securing plate, including at least two points that are of nailed units formed by setting up a part of the securing plate and a root of the spring unit, and supports the bimetal from a side surface, and a distal end of the nailed part is formed so as to be at a position higher than the spring unit when the contact between the moving contact and the fixed contact is canceled.

4. The thermostat according to claim 1, wherein the terminal unit is fixed together with the insulating plate via a hole provided in a terminal unit of the insulating plate.

5. The thermostat according to claim 1, wherein the insulating plate is a ceramic substrate of a ceramic substrate type heater, and the terminal unit of the movable plate, by being electrically connected to one of a plurality of electrodes incorporated into the heater and by being fixed on the ceramic substrate, is connected in series with the heater and adjusts a heating temperature of the heater.

* * * * *